United States Patent [19]

Onishi et al.

[11] Patent Number: 4,545,428

[45] Date of Patent: Oct. 8, 1985

[54] HEAT EXCHANGER FOR AIR CONDITIONING SYSTEM

[75] Inventors: Toshiya Onishi; Susumu Oshima; Hiromi Mikata; Haruo Nakata; Masami Horiuchi, all of Sakai, Japan

[73] Assignee: Daikin Kogyo Co., Ltd., Osaka, Japan

[21] Appl. No.: 645,255

[22] Filed: Aug. 29, 1984

Related U.S. Application Data

[60] Division of Ser. No. 452,149, Dec. 22, 1982, Pat. No. 4,480,684, which is a continuation of Ser. No. 129,463, Mar. 11, 1980, abandoned.

[30] Foreign Application Priority Data

May 16, 1979 [JP] Japan ..... 54-65952

[51] Int. Cl.[4] ..... F25B 39/02; F25B 39/04

[52] U.S. Cl. ..... 165/110; 62/324.1; 138/38; 165/133; 165/179; 165/184

[58] Field of Search ..... 165/151, 150, 133, 110, 165/179, 184; 138/38; 62/324.1, 494

[56] References Cited

U.S. PATENT DOCUMENTS

| | | | |
|---|---|---|---|
| 2,279,548 | 4/1942 | Bailey | 165/179 |
| 2,691,281 | 10/1954 | Phillips | 62/494 |
| 3,078,690 | 2/1963 | Phillips et al. | 62/494 |
| 3,134,166 | 5/1964 | Venables, III . | |
| 3,160,129 | 12/1964 | Venables, III . | |
| 3,612,175 | 10/1971 | Ford | 165/179 |
| 4,044,797 | 8/1977 | Fujie et al. | 165/179 |
| 4,224,984 | 9/1980 | Miyata et al. | 165/184 |
| 4,305,460 | 12/1981 | Yamplosky | 165/179 |

FOREIGN PATENT DOCUMENTS 38-8442 6/1963 Japan .

*Primary Examiner*—Albert W. Davis, Jr.
*Attorney, Agent, or Firm*—Cushman, Darby & Cushman

[57] ABSTRACT

In a heat exchanger for an air conditioning system including a plurality of heat exchanger tubes and a plurality of fins secured to outer surfaces of the heat transfer tubes, the fins are of a special constructional form, such as slitted fins having slits formed in flat or convoluted fins or spine fins, and the heat transfer tubes are each formed on its inner wall surface with spiral grooves or two systems of spiral grooves of large number. The heat transfer tubes define therein a refrigerant passage while the adjacent two fins define therebetween an air passage extending past the outer surfaces of the heat transfer tubes.

4 Claims, 16 Drawing Figures

HEAT EXCHANGER FOR AIR CONDITIONING SYSTEM

This is a divisional of copending application Ser. No. 452,149, filed Dec. 22, 1982, which became Patent No. 4,480,684 and which in turn was a continuation of copending application Ser. No. 129,463, filed Mar. 11, 1980, now abandoned.

BACKGROUND OF THE INVENTION (1) Field of the Invention

This invention relates to heat exchangers for air conditioning systems, and more particularly it is concerned with a heat exchanger for an air conditioning system which permits heat exchange to take place between a refrigerant flowing through a refigerant passage inside heat tranfer tubes and air flowing outside the heat transfer tubes, or more specifically to a heat exchanger of the type described which enables a high coefficient of overall heat transmission to be achieved by improving the coefficient of heat transfer to and from the air and the coefficient of heat transfer to and from the refrigerant.

(2) Description of the Prior Art

In this type of heat exchanger for an air conditioning system, it is usual practice to use, in combination, heat transfer tubes or smooth tubes which are planar and smooth on inner and outer wall surfaces, and fins secured to outer wall surfaces of the heat transfer tubes. The fins may be flat fins, corrugated or convoluted fins, slitted fins having slits formed in flat fins by pressing-out strips, slitted convoluted fins having slits formed in convoluted fins by pressing-out strips, spine fins, etc. The heat exchangers of the prior art have been developed for the purpose of improving their heat exchange performance by improving the coefficient of heat transfer to and from air which is lower than the coefficient of heat transfer to and from refrigerant.

Any attempt to improve the coefficient of heat transfer to and from air raises the problem that a resistance to the flow of air is increased. Another problem raised is that thermal resistance is increased when the heat given off by the air is transmitted through the heat transfer tubes to the refrigerant. Thus there are limits to the improvements that could be provided to the heat exchange performance by improving the coefficient of overall heat transmission through improvement of the coefficient of heat transfer to and from the air.

SUMMARY OF THE INVENTION

This invention has been developed for the purpose of obviating the aforesaid problems of the prior art.

Accordingly, a principal object of the invention is to provide a heat exchanger for an air conditioning system wherein improvement of the coefficient of heat transfer to and from the refrigerant flowing through a refrigerant passage inside heat transfer tubes can be achieved simultaneously as improvement of the coefficient of heat transfer to and from the air flowing outside the heat transfer tubes is achieved, to thereby improve the coefficient of overall heat transmission of the heat exchanger.

Another object of the invention is to provide a heat exchanger capable of achieving a high coefficient of overall heat transmission when it is caused to function as a condenser in a refrigerant circulating cycle.

Still another object of the invention is to provide a heat exchanger capable of acting a high coefficient of overall heat transmission when it is caused to function selectively as a condenser or an evaporator in a refrigerant circulating cycle of the heat pump type.

The outstanding characteristics of the invention are that the fins located along the air passage are of a configuration which enables the coefficient of heat transfer on the air side to be increased to over 1.2 times that of flat fins, and the heat transfer tubes defining a refrigerant passage therethrough are formed on the inner wall surfaces thereof with a multiplicity of spiral grooves. The fins may be slitted fins, slitted convoluted fins, spine fins, etc. The outer diameter of the heat transfer tubes may be in the range between 6 and 16 mm. The grooves have a depth in the range between 0.1 and 0.6 mm; the groove pitch or the spacing interval between the adjacent grooves is in the range between 0.2 and 0.6 mm; the spiral ridge formed by the adjacent grooves has a vertical angle in the range between 50° and 100°; and the helical angle of the grooves with respect to the tube axis is in the range between 16° and 35°. The spiral grooves may consist of two spiral groove systems crossing one another and forming oppositely directed angels of skew with respect to the tube axis. The two systems of spiral grooves may have helical angles of different values with respect to the tube axis, and the depths of the spiral grooves of the two systems may also be distinct from each other.

DESCRIPTION OF THE PREFERRED EMBODIMENTS

Figure 1:
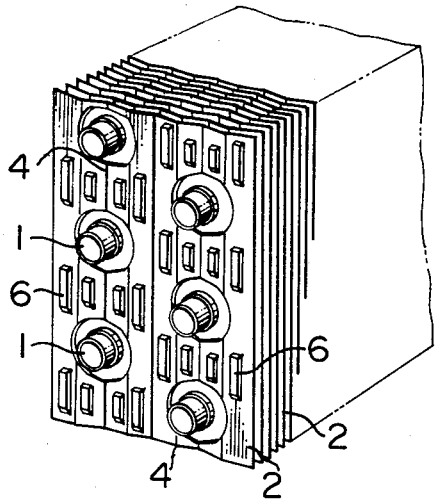
FIG. 1 is a fragmentary perspective view of a heat exchanger comprising one embodiment of the invention.
Figure 3:
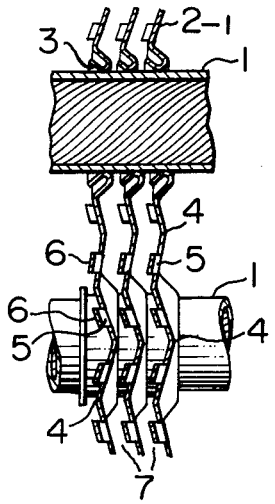
FIG. 3 is a fragmentary plan view, on an enlarged scale, of the heat exchanger shown in FIG. 1, with its essential portions being shown in section.
Figure 2:
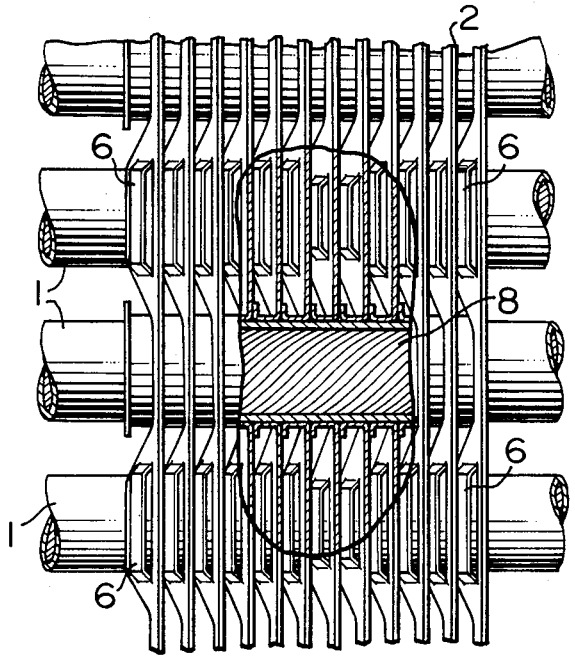
FIG. 2 is a front view of the heat exchanger shown in FIG. 1, with certain parts being shown in section.
Figure 4:
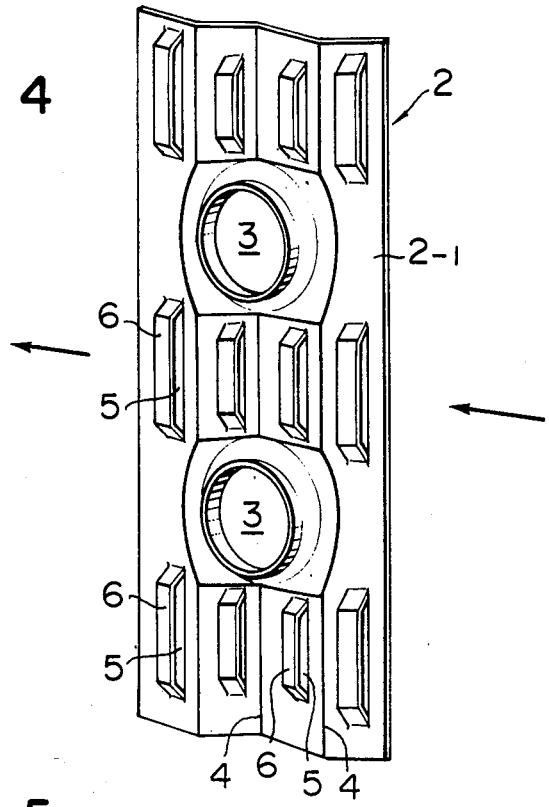
FIG. 4 is a perspective view, on an enlarged scale, of the essential portions of one of the fins of the heat exchanger shown in FIG. 1.

FIGS. 1–4 show the constructional form of one preferred embodiment of the heat exchanger in conformity with the present invention. As shown, the heat exchanger comprises a plurality of heat transfer tubes 1 arranged substantially parallel to one another in a plurality of rows and layers, and a plurality of fins 2 secured to the external surfaces of the heat transfer tubes 1 and arranged at right angles to the axis of each tube 1 to extend outwardly therefrom. A refrigerant flows through a refrigerant passage inside the heat transfer tubes 1, and air flows through a passage defined between the adjacent fins 2 and at right angles to the axis of each heat transfer tube 1.

The fins 2 of the heat exchanger are slitted convoluted fins, and the transfer tubes 1 are each formed on the inner wall surface thereof with a multiplicity of spiral grooves 8, so that the tubes 1 are in the form of inner wall surface worked tubes. The fins 2 are formed mainly of aluminum, and the tubes 1 are formed of either copper or aluminum.

The fins 2 are produced as follows. A convoluted fin plate 2-1 is formed with a plurality of tube receiving openings 3 arranged in a plurality of rows in such a manner that the openings 3 in the adjacent rows are offset. Slits 5 are formed in the plate 2-1 by pressing out strips or tongues 6 in a space between the adjacent openings 3 of the same row so that the slits are parallel to ridges 4 of the convoluted fin plate 2-1. The slits 5 and tongues 6 are configured such that they have a larger dimension lengthwise of the ridges 4 than crosswise thereof.

The tongues 6 are each separated from and disposed above the convoluted fin plate 2-1 at the long sides thereof, but connected to the plate 2-1 at the short sides thereof.

The fins 2 of the aforesaid construction are secured to the heat transfer tubes 1 arranged in a plurality of rows and in a plurality of layers, to define a convoluted air passage 7 between the adjacent fins 2. Air is introduced into the heat exchanger in a direction in which it flows at right angles to the ridges 4 of the convoluted fin plate 2-1.

The currents of air flowing through the convoluted air passages 7 between the fins 2 pass in zigzag motion and swirl in turbulent flow at the ridges 4 where they change their direction. Part of the air flows through the slits 5 into the adjacent air passages 7, to thereby increase the turbulence of air currents by the synergystic effect.

The tongues 6 have edge effect when the currents of air impinge thereagainst, so that thermal boundary layer buildup can be avoided and the air-side coefficient of heat transfer taking plate between the air and the fins 2 can be improved.

Although the fins 2 have been described as being slitted convoluted fins, it is to be understood that the invention is not limited to this specific form of the fin and that any other fins, such as slitted fins which are flat fins formed with slits, convoluted fins, spine fins (subsequently to be described), etc. may be used.

Figure 11:
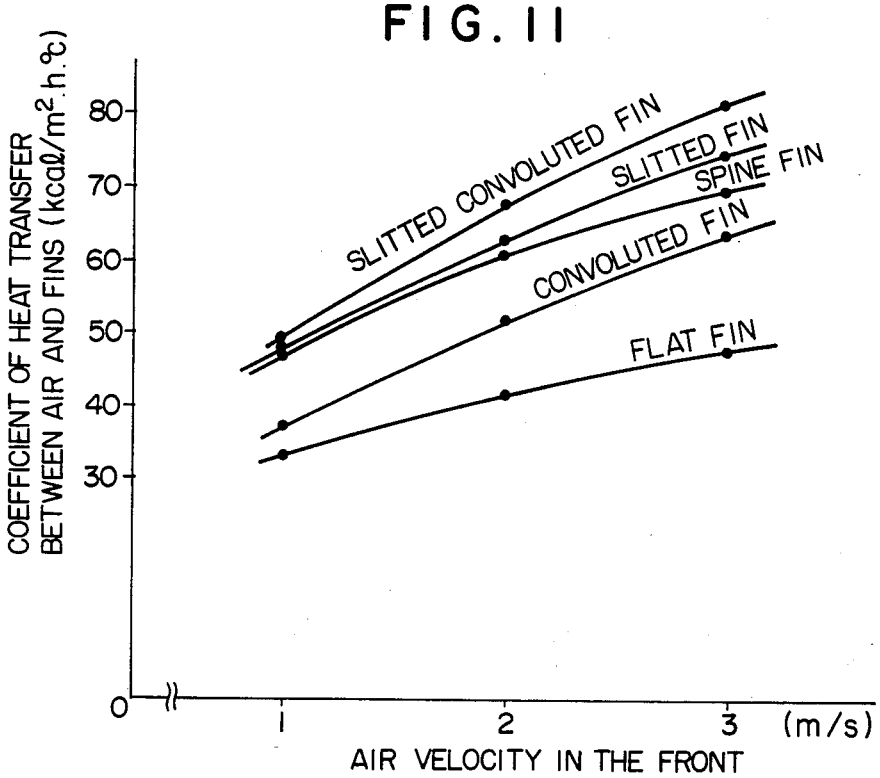
FIG. 11 is a graph showing coefficients of heat transfer between air and various fin plates.

The results of tests conducted on the coefficient of heat transfer between air and fins with the slitted convoluted fin, slitted fin, spine fin and convoluted fin as contrasted with the ordinary flat fin are shown in FIG. 11. It will be seen that the slitted convoluted fin has the highest air-side coefficient of heat transfer, followed by the slitted fin, spine fin, convoluted fin and flat fin in the indicated order. The fins that can have application in the heat exchanger according to the invention are such fins that the coefficient of heat transfer to and from air is over 1.2 times that of flat fins. That is, the fins used in the invention are the slitted convoluted fin, slitted fin, spine fin and the type of convoluted fin that has a high air velocity. It is to be understood that when the convoluted fin is of special form, the convoluted fin can be used in the range of air velocities that can be used for practical purposes.

Figure 5:
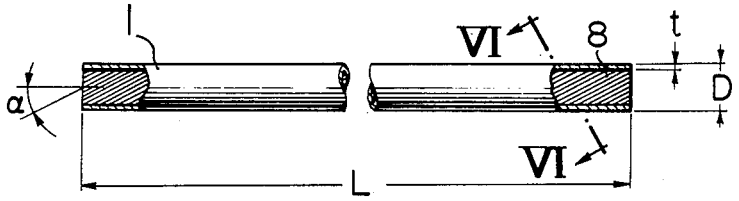
FIG. 5 is a fragmentary front view of one form of heat transfer tube according to the invention, with certain parts being cut out.
Figure 6:
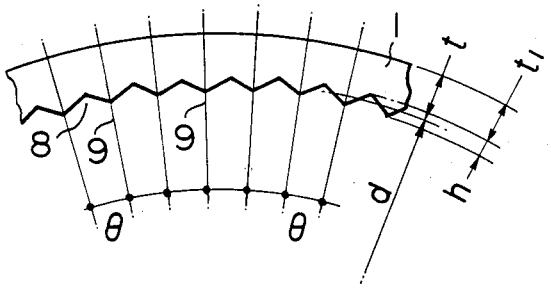
FIG. 6 is a fragmentary sectional view, on an enlarged scale, taken along the line VI—VI in FIG. 5.

The heat transfer tubes 1 are characterized by being formed with a multiplicity of spiral grooves 8 on the inner wall surfaces thereof. The spiral grooves 8 may be either unidirectional so that the grooves 8 are right-handed or left-handed or bidirectional so that they are oriented in two directions. The heat transfer tube 1 shown in FIGS. 5 and 6 is formed with the spiral grooves 8 of unidirectional type so that a multiplicity of sharp tops 9 are arranged between the grooves 8 and oriented substantially toward the center of the tube 1.

In forming the spiral grooves 8, the tops and the bottoms can be alternately arranged by shaping the grooves as V-shaped or U-shaped grooves of equal depth or different depths, so that the heat transfer tube 1 having its inner wall surface worked can have the area of its inner wall surface increased.

The heat transfer tube 1 shown in FIGS. 5 and 6 has specification shown in Table 1 below. The tube 1 is a seamless tube formed of phosphorus-deoxidized copper, which is identified as C1220TS-0 (containing over 99.90% copper and 0.015-0.040% phosphorus) by JIS (Japanese Industrial Standards) H3300, 1977, and subjected to hardening treatment at its outer wall surface.

TABLE 1

| Material (JIS) | Outer Diameter (mm) | Mean Thickness (mm) | No. of Grooves in Circumference | Groove Depth (mm) | Groove Bottom Thickness (mm) | Mean Inner Diameter (mm) | Angle (α°) | Angle (θ°) |
|---|---|---|---|---|---|---|---|---|
| 0122OTS-0 | 9.52 | 0.41 | 65 | 0.15 | 0.34 | 8.70 | 25 | 5.54 |

When a refrigerant in a liquid state is allowed to flow through the heat transfer tube 1 of Table 1, the refrigerant-side coefficient of heat transfer is greatly improved as the refrigerant evaporates, by virtue of the factors which include an increased heat exchange surface brought about by an increase in the surface area of the inner wall surface of the tube due to formation of a multiplicity of elevations, increased turbulence effect attributed to alternate arrangement of elevations and depressions, and marked promotion of evaporation of the liquid refrigerant due to an increase in the number of bubble nuclei bringing about nucleate boiling which is attributed to the presence of a multiplicity of spiral grooves.

On the other hand, when a refrigerant in a gaseous state is allowed to flow through the heat transfer tube 1 of table 1, the refrigerant-side coefficient of heat transfer is increased as the gaseous refrigerant is condensed by virtue of the factors including an increase in the surface area due to the presence of the elevations, promotion of condensation by conversion of the rear sides of the slopes of the elevations into condensing surfaces having high liquid agitation effect due to turbulence and formation of nuclei at the top of the elevations to promote condensation (which is referred to as corwise effect at condensation), and a reduction in the thickness of a film of condensate formed on the heat transfer surface which is attributed to the tops of the elevations bringing about a reduction in the wetting of the inner wall surface of the tube.

This type of heat exchanger may be used either as an evaporator or a condenser in the refrigerant circulating cycle of an air conditioning system, or may be used as an evaporator or a condenser of the heat pump type by switching the refrigerant circulating cycle between cooling and heating modes. It has been found that when a multiplicity of spiral grooves are formed on the inner wall surface of the heat transfer tube for the purpose of improving the performance of this type of heat exchanger, the performance of the heat exchanger is improved as an evaporator but its performance as a condenser is not much improved.

It has been ascertained that the heat transfer tubes formed with spiral grooves show a greatly improved performance in evaporating a refrigerant when incorporated in a heat exchanger, and that since exchange of latent heat takes place on the surfaces of the fins, the moisture content of air is turned into dew on the surfaces of the fins to increase the apparent coefficient of heat transfer on the side of the air, with a result that the heat exchange performance of the heat exchanger can be substantially increased.

However, when the heat transfer tubes formed with spiral grooves on the inner wall surfaces are incorporated in a heat exchanger for condensation, the heat exchanger is unable to show improved performance which has been possible when the heat exchanger is for evaporation, owing to the facts that the improvement in condensation performance of the tubes themselves is not as high as the improvement in evapolation performance of the tubes and that the heat exchange taking place on the surfaces of the fins only takes place in sensible heat.

In fabricating a heat exchanger, it is usual practice to secure the heat transfer tubes to the fins by forcibly inserting a tube expanding plug into the bore of each tube. Thus it is inevitable that the spiral grooves on the inner wall surfaces of the heat tranfer tubes are slightly deformed by the plug. The results of experiments show that this change in the configuration of the spiral grooves increases the evaporation performance by 5–10% but decreases the condensation performance by 5–20%.

Thus the knowledge gained by experiments shows that in a heat exchanger functioning as a condenser, it is necessary not only to form a multiplicity of spiral grooves on the inner wall surface of each heat transfer tube but also to impart to the grooves some special configuration, if it is desired to further improve the condensation performance of the heat exchanger.

The outstanding characteristics of the present invention are that the spiral grooves 8 have a depth in the range between 0.1 and 0.6 mm and a pitch in the range between 0.2 and 0.6 mm, in the heat transfer tubes 1 having an outer diameter in the range between 6 and 16 mm; the spiral ridge formed by the adjacent grooves has a vertical angle in the range between 50° and 100°; and the helical angle $\alpha$ with respect to the axis of the tube is in the range between 16° and 35°.

With the heat transfer tubes 1 satisfying the aforesaid conditions according to the invention being incorporated in a heat exchanger which functions as a condenser in a refrigerant circulating cycle of an air conditioning system using a fluorinated hydrocarbon refrigerant or as a condenser or an evaporator by switching the refrigerant circulating cycle between heating and cooling modes, it has been found that the refrigerant-side coefficient of heat transfer can be improved and that the distinction between the refrigerant-side coefficient of heat transfer achieved in a condensation mode and the refrigerant-side coefficient of heat transfer achieved in an evaporation mode can be minimized.

Various experiments have been conducted on the aforesaid characteristics of the heat transfer tube according to the invention. Their results are shown in FIGS. 7 and 8.

Figure 7:
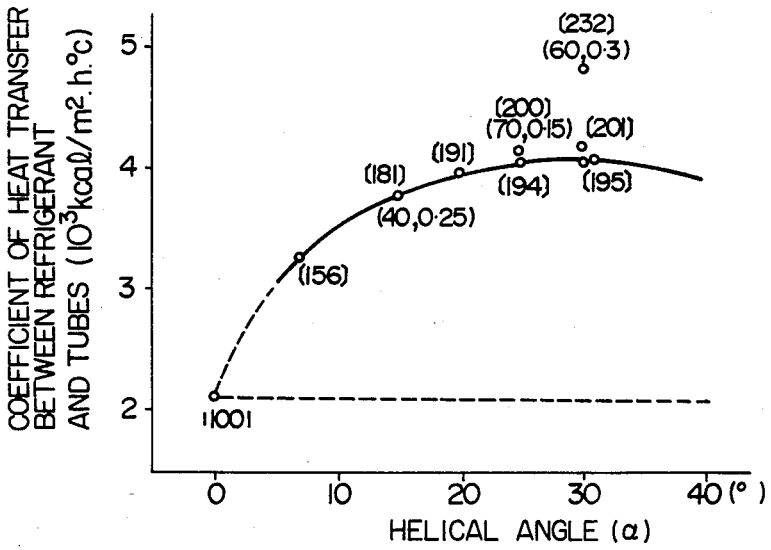
FIGS. 7–10 are diagrammatic representations of various characteristics of one embodiment of heat exchanger in conformity with the invention, FIG. 7 being a graph showing a characteristic of the heat exchanger serving as a condenser, with the ordinate representing the refrigerant-side coefficient of heat transfer and the abscissa indicating the helical angle of the grooves, FIG. 8 being a graph showing a characteristic of the heat exchanger serving as an evaporator, with the ordinate representing the refrigerant-side coefficient of heat transfer and the abscissa indicating the helical angle of the grooves, FIG. 9 being a graph showing a characteristic of the heat exchanger serving as both a condenser and an evaporator, with the ordinate representing the ratio of the refrigerant-side coefficient of heat transfer of one form of heat transfer tube according to the invention to the refrigerant-side coefficient of heat transfer of a smooth tube of the prior art and the abscissa indicating the depth of the grooves of the heat transfer tube, and FIG. 10 being similar to FIG. 9 except that the ordinate represents the ratio of the pressure drops.

FIG. 7 is a graph showing a condensation operation in which the ordinate represents the refrigerant-side coefficient of heat transfer and the abscissa indicates the helical angle $\alpha$. In the figure, numbers in brackets ( ) refer to the number of grooves in circumference and groove depth and numbers in brackets [ ] refer to increases over grooveless tubes. It will be seen that when the helical angle $\alpha$ is about 7° the value obtained is 156% of the value obtained with a grooveless tube and that when the helical angle $\alpha$ is about 25° the value is greatly increased to 194% of the value obtained with a grooveless tube. It will also be seen that with the helical angle range of 16° to 35° C. a rise in the coefficient of heat transfer is substantially flat, indicating that the heat transfer tubes according to the invention can be put to practical use with satisfactory results.

Figure 8:
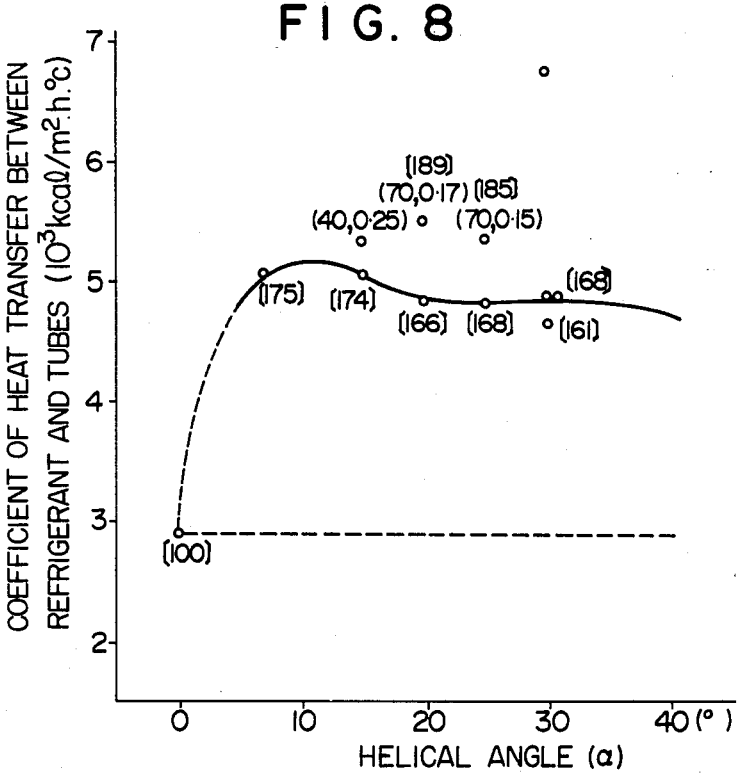

FIG. 8 is a graph showing an evaporation operation in which the ordinate represents the refrigerant-side coefficient of heat transfer and the abscissa indicates the helical angle $\alpha$. Numbers in brackets refer to the same as those in FIG. 7. The coefficient of heat transfer is maximized when the helical angle $\alpha$ is near 7° and tends to drop when the helical angle $\alpha$ is over 16°. However, the drop is minimal and the heat transfer tube according to the invention can be put to practical use with satisfactory results.

The heat transfer tubes 1 of the following specifications were used in experiments in which the performance of the heat transfer tubes themselves was tested in straight tube using water without using fins. The specifications were: outer diameter of tube (D), 9.52 mm; mean thickness of tube (t), 0.41 mm; number of grooves in circumference, 65; groove pitch, 0.4 mm (groove pitch is the spacing interval between the adjacent grooves obtained by dividing the length of the inner circumference of tube by the number of grooves); groove depth (h), 0.15 mm; groove bottom thickness ($t_1$), 0.34 mm; helical angle ($\alpha$), 25°; and vertical angle of helical ridges 90°. The results show that the refrigerant-side coefficient of heat transfer ($\alpha R$) is 4,072 kcal/m$^2$.h.°C. in a condensation mode which represents 194% of the value of the grooveless tube, under the following experimental conditions: condensation temperature, 50° C.; degree of subcooling, 4° C.; amount of refrigerant in circulation, 47 kg/h; and water-side coefficient of heat transfer, 4300–4600 kcal/m$^2$.h.°C.

In an evaporation test under the conditions of evaporation temperature 0° C., degree of superheating, 5° C.; amount of refrigerant in circulation, 46 kg/h; and water-side coefficient of heat transfer, 3300–3500 kcal/m$^2$.h.°C., the refrigerant-side coefficient of heat transfer ($\alpha R$) was 4900 kcal/m$^2$.h.°C. which is 168% of the value obtained with the inner wall surface non-worked tube.

Figure 9:
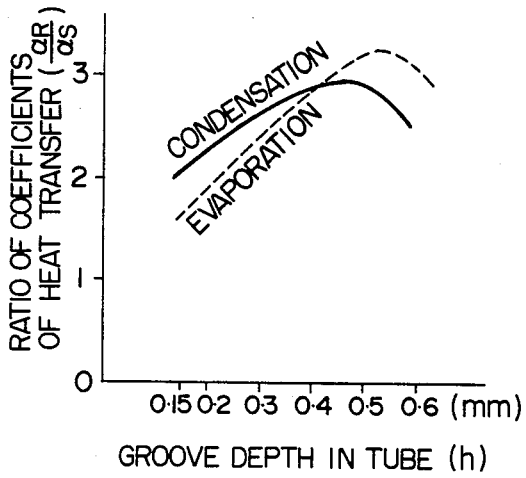

FIG. 9 is a graph in which the ordinate represents the ratio of the refrigerant-side coefficient of heat transfer ($\alpha R$) achieved by the heat transfer tube according to the invention to the refrigerant-side coefficient of heat transfer ($\alpha S$) achieved by an inner wall surface non-worked tube of the prior art, and the abscissa indicates the groove depth (h) of the heat transfer tube according to the invention. It will be seen in the graph that when the groove depth (h) is 0.15 mm the ratio of the coefficients of heat transfer ($\alpha R/\alpha S$) is about 1.6 times in an evaporation mode and about 2.0 times in a condensation mode.

Figure 10:
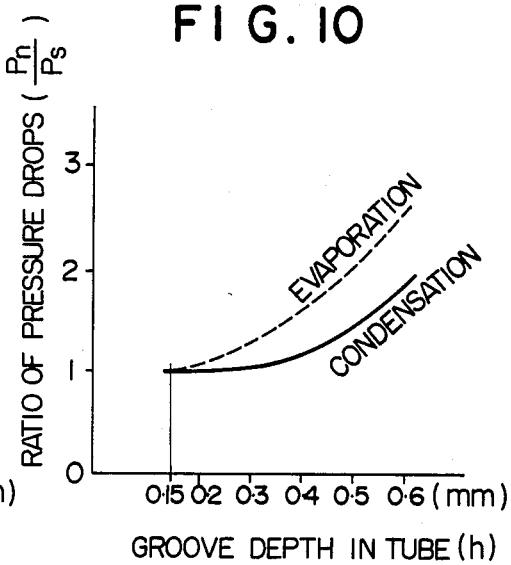

FIG. 10 is a graph in which the ordinate represents the ratio of pressure drop (Pn) to pressure drop (Ps), and the abscissa indicates the groove depth (h) in the tube. When the groove depth (h) is 0.15 mm the ratio Pn/Ps is 1 both in evaporation and condensation modes, indicating that the heat exchanger using the heat transfer tubes according to the invention has the same pressure drop as the heat exchanger using the inner wall surface non-worked tubes of the prior art.

When the groove depth (h) is 0.6 mm, the ratio of the coefficients of heat transfer ($\alpha R/\alpha S$) is about 3.0 times in an evaporation mode and about 2.5 times in a condensation mode, while the ratio of pressure losses (Pn/Ps) is about 2.5 times in an evaporation mode and about 2.0 times in a condensation mode, thereby indicating that the ratio of the coefficients of heat transfer ($\alpha R/\alpha S$) can be greatly increased as compared with the ratio of pressure losses (Pn/Ps). Thus the heat transfer tubes according to the invention can be put to practical use with satisfactory results.

The heat transfer area of the inner wall surface of the heat transfer tube 1 can be greatly increased by setting the vertical angle B of the spiral ridges at a level below 100°. When the vertical angle B is set at a level below 50°, formation of the spiral grooves 8 is greatly facilitated in producing the heat transfer tube 1 according to the invention.

Figure 12:
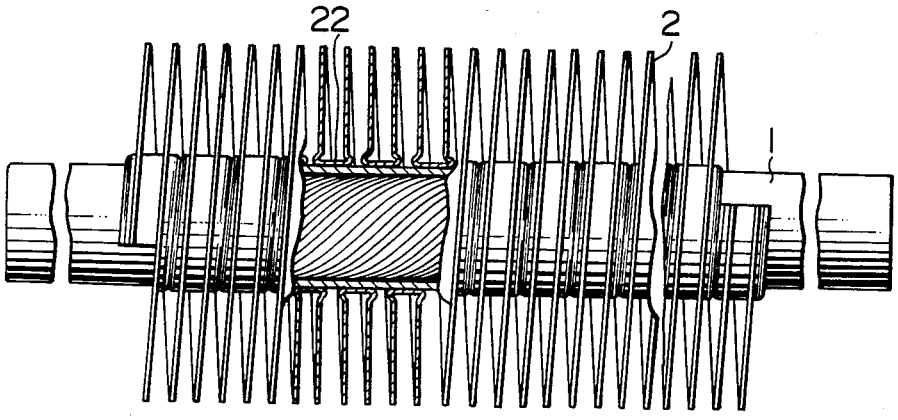
FIG. 12 is a front view of the essential portions of another embodiment of the invention, with certain parts being cut out.
Figure 13:
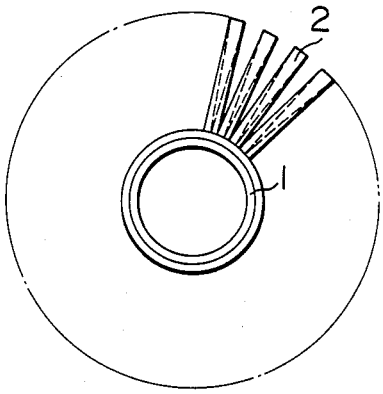
FIG. 13 is a side view of the embodiment shown in FIG. 12.

Another embodiment of the heat exchanger according to the invention shown in FIGS. 1–4 is shown in FIGS. 12 and 13, in which the heat transfer tube 1 having its inner wall surface worked as described hereinabove to form the spiral grooves 8 thereon has a spine fin 2 fitted thereto. The spine fin 2 also has edge effect with respect to a current of air and is capable of causing turbulence to the air current, to thereby improve the coefficient of heat transfer to and from the air.

The spine fin 2 may be fabricated as follows. A series of flat plates are each bent into a substantially U-shape having the longitudinal center line at the center, and the base which contacts the tube 1 slightly swells laterally past the opposed legs in cross section as indicated at 22. Cuts are formed at small pitch in the lgs so that the plates of the aforesaid construction can be used as fin material. By spirally winding the fin material on the tube 1 in such a manner that the base of each U-shape is secured to the tube 1 and then the fin material is joined by brazing to the tube 1. Thus a heat exchanger having the heat transfer tubes 1 each having the spine fin extending radially therefrom can be readily provided, as illustrated.

The heat exchange performance (coefficient of overall heat transmission) of the heat exchanger according to the invention was tested by using the heat exchanger in an air conditioning system of the heat pump type, under the same conditions as the heat transfer tube 1 was tested as described previously for its performance as a tube. The results obtained are shown in Table 2. Table 2 shows, for comparison, the heat exchange performance of a heat exchanger using flat fins.

TABLE 2

| Coefficient of Overall Heat Transmission (kcal/m$^2$ · h · °C., G = 45 kg/h) | | | | | | | | | |
|---|---|---|---|---|---|---|---|---|---|
| Slitted Convoluted Fins Used (Present Invention) | | | | Spine Fins Used (Present Invention) | | Flat Fins Used | | | |
| Indoor Use | | Outdoor Use | | Outdoor Use | | Indoor Use | | Outdoor Use | |
| Evaporation | Condensation | Evaporation | Condensation | Evaporation | Condensation | Evaporation | Condensation | Evaporation | Condensation |
| 1140 (123) | 915 (122) | 1010 (123) | 820 (120) | 1150 (121) | 960 (121) | 830 (114) | 640 (112) | 750 (113) | 580 (113) |

In Table 2, the numerals in the brackets refer to the ratios of the coefficients of overall heat transmission (%) with respect to the heat exchanger using the same fins but using grooveless heat transfer tubes. In the experiments, the air velocity in the front of the heat exchangers was 2 m/s for indoor use and 1.5 m/s for outdoor use.

As is clear in Table 2, the heat exchangers provided with slitted convoluted fins and spine fins can have their coefficients of overall heat transmission increased by about 20% by forming spiral grooves on the inner wall surface of each heat transfer tube. The performance of these heat exchangers as evaporators shows little difference from their performance as condensers. The heat exchanger provided with flat fins was only able to increase its coefficient of overall heat transmission by about 13% when the inner wall surface of each heat transfer tube was formed with spiral grooves. From the results of the tests, it will be appreciated that a heat exchanger having heat transfer tubes formed with spiral grooves used in combination with fins of higher coefficient of heat transfer than flat fins, such as slitted convoluted fins and spine fins, can greatly improve its heat exchange capability.

Figure 14:
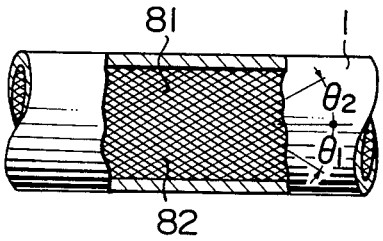
FIG. 14 is a fragmentary front view, with certain parts being cut out, of another form of heat transfer tube according to the invention.
Figure 15:
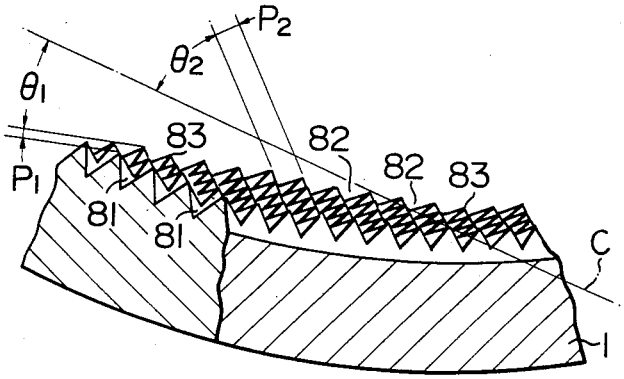
FIG. 15 is a view showing, on an enlarged scale, the essential portions of the heat transfer tube shown in FIG. 14, the view being shown in two sections, one being taken along the tube axis and the other being taken along the center line of one system of spiral grooves.
Figure 16:
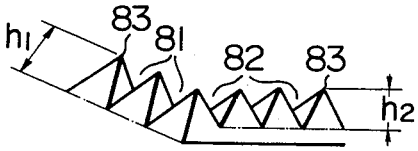
FIG. 16 is a view showing, on an enlarged scale, the cuts made in FIG. 15.

The embodiment of the invention shown in FIGS. 1–4 and the other embodiment shown in FIGS. 12 and 13 have the multiplicity of spiral grooves 8 of the same angle and same direction (unidirectional) with respect to the axis of the heat transfer tube 1. The invention is not limited to this specific form of the spiral grooves and two systems of spiral grooves 81 and 82 may be formed on the inner wall surface of the tube 1 as shown in FIGS. 14–16 in such a manner that the spiral grooves 81 and 82 cross one another and form oppositely directed angles of skew with respect to the axis of the tube 1.

More specifically, the two systems of spiral grooves 81 and 82 may be V-shaped or U-shaped having the same depth or different depths. By this arrangement, a multiplicity of quadrilateral pyramidic projections 83 are formed on the inner wall surface of the tube 1 and each have a top where the ridges defining the grooves 81 and 82 cross one another, so that a multiplicity of inclined flow passages for the refrigerant crossing one another are defined between the pyramidic projections 83. As a result, the heat transfer tube 1 can have the area of its inner wall surface greatly increased.

When the heat transfer tube 1 of the aforesaid construction is used with a heat exchanger, the refrigerant-side coefficient of heat transfer of the heat exchanger can be further increased in an evaporation mode in which a refrigerant in a liquid state is passed through the tube 1 as compared with the embodiments shown in FIGS. 1–4 and FIGS. 12 and 13 by virtue of the factors including an increase in the heat exchange surface area of the inner surface of the tube due to the large surface area of each projection 83 of pyramidic shape, production of turbulence in the flow of liquid refrigerant due to the presence of pyramidic projections 83 arranged in rows, and nucleate boiling caused to take place by an increase in the number of spiral grooves defined by the projections 83.

On the other hand, in a condensation mode in which a refrigerant in a gaseous state is passed through the tube 1, the refrigerant-side coefficient of heat transfer is increased by virtue of the factors including an increase in the heat exchange surface area of the inner surface of the tube due to the large surface area of each projection 83 of pyramidic shape, corwise effect at condensation which promotes condensation as the result of the rear sides of the slopes of the pyramidic projections 83 being converted into condensing surfaces of high agitation effect due to turbulent flow and the top of each projection 83 forming nuclei, and a reduced thickness of a liquid film on the heat exchange surface of each projection brought about by one system of spiral grooves functioning to provide main stream of refrigerant and the other system of spiral grooves functioning to provide branch streams of refrigerant so that the system of spiral grooves forming the main streams of the refrigerant plays the role of discharging condensate from the tube.

In the heat transfer tube 1 shown in FIGS. 14–16, the two systems of spiral grooves 81 and 82 are slightly distinct in the groove depth. The spiral grooves 81 of larger groove depth allowing main streams of refrigerant to flow therethrough are crossed by the spiral grooves 82 of smaller groove depth allowing branch streams of refrigerant to flow therethrough. Thus on the inner wall surface of the tube 1, there are formed main streams of liquid refrigerant flowing spirally along the main flow passages, and branch streams of liquid refrigerant flowing through the branch flow passages crossing the main flow passages. Thus the flow of the liquid refrigerant can be utilized with greater effect by arranging the liquid refrigerant in two different stream patterns, thereby enabling the heat transfer tube 1 to achieve a higher coefficient of heat transfer.

It has been ascetained as the results of tests that when the depths of the grooves 81 and 82 or the depths $h_1$ and $h_2$ of spiral grooves (heights of ridges) defined by pyramidic projections 83 of different slope areas have the relation $h_2 \leqq 4/5\ h_1$, the heat transfer tube 1 has a low pressure drop and a high coefficient of heat transfer.

It has also been ascertained that the performance of the heat transfer tube 1 can be improved by setting the different helical angles $\theta_1$ and $\theta_2$ of the two systems of spiral grooves 81 and 82 with respect to the axis of the tube 1 in the ranges between 5 and 15° ($\theta_1$) and 8 and 45° ($\theta_2$) respectively, by setting the groove pitches $P_1$ and $P_2$ of adjacent grooves in the range between 0.15 and 0.5 mm, and by setting the depth $h_1$ of the spiral grooves 81 of larger groove depth in the range between 0.1 and 0.5 mm.

As described hereinabove, the fins according to the invention which may be slitted fins, slitted convoluted fins, spine fins, etc., have an air-side coefficient of heat transfer which is over 1.2 times that of flat fins, and the heat transfer tubes 1 providing a flow passage for a refrigerant are formed on the inner wall surfaces thereof with a multiplicity of spiral grooves 8. Thus the invention increases the coefficient of overall heat transmission of a heat exchanger for an air conditioning system by increasing the coefficient of heat transfer to and from the refregerant flowing through the tubes 1 simultaneously as increasing the air-side coefficient of heat transfer.

According to the invention, the grooves 8 formed on the inner wall surface of the heat transfer tube 1 which may have an outer diameter in the range between 6 and 16 mm has a depth in the range between 0.1 and 0.6 mm, the groove pitch or the spacing interval between the adjacent grooves is in the range between 0.2 and 0.6 mm, the spiral ridge formed by the adjacent grooves 8 has a vertical angle in the range between 50° and 100°, and the helical angle of the spiral grooves 8 with respect to the axis of the tube 1 is in the range between 16° and 35°. By these features, the heat exchanger according to the invention can have its coefficient of overall heat transmission greatly improved when the heat exchanger functions as a condenser in a refrigerant curculating cycle. The heat exchanger according to the invention can also have its coefficient of overall heat transmission greatly improved when caused to function either as a condenser or an evaporator in a refrigerant circulating cycle of the heat pump type.

The spiral grooves formed on the inner wall surface of the heat transfer tube 1 may consist of two systems of spiral grooves 81 and 82 crossing one another and forming oppositely directed angles of skew with respect to the axis of the tube 1. The two systems of spiral grooves 81 and 82 may have different helical angles with respect to the axis of the tube 1, and may have different groove depths, thereby further increasing the refrigerant-side coefficient of heat transfer to further improve the coefficient of overall heat transmission of the heat exchanger.

What is claimed is:

1. A heat exchanger for an air conditioning system comprising:

a plurality of heat transfer tubes having their respective axes arranged substantially parallel to one another;

a multiplicity of spine fins secured to an outer surface of each of said heat transfer tubes and extending radially outwardly thereof;

a refrigerant flow passage defined inside each of said heat transfer tubes;

air passages each defined by the adjacent spine fins secured on the outer surface of each of said heat transfer tubes;

said spine fins being formed such that a multiplicity of parallel cuts are formed at small pitch in each of fin-base plates, except for their respective base portions, to form a multiplicity of legs, the respective base portions of said fin-base plates being wound around and secured to the outer surfaces of the respective heat transfer tubes so that said legs extend radially outwardly from said heat transfer tubes;

said spine fins being of a constructional form such that their coefficient of heat transfer to and from the air is over 1.2 times that of flat fins;

each of said heat transfer tubes being formed on the inner wall surface thereof with a multiplicity of spiral grooves;

said heat transfer tubes each having an outer diameter in the range between 6 and 16 mm;

said spiral grooves formed on the inner wall surface of each of said heat transfer tubes having a depth in the range between 0.1 and 0.6 mm and a pitch in the range between 0.2 and 0.6 mm;

the respective spiral ridges formed by the adjacent twos of said spiral grooves each having a sharp-apex, V-shaped cross-section and a vertical angle in the range between 50° and 100°;

the spiral grooves formed on the inner wall surface of each of said heat transfer tubes each having a helical angle with respect to the axis of the tube in the range between 16° and 35°; and said heat exchanger being incorporated in a refrigerant circulating cycle of a heat-pump type so as to function selectively as a condenser and an evaporator therein.

2. A heat exchanger as claimed in claim 1, wherein said heat transfer tubes are each formed on its inner wall surface with two systems of a multiplicity of spiral grooves crossing one another and forming oppositely directed angles of skew with respect to the axis of each of said heat transfer tubes.

3. A heat exchanger as claimed in claim 1, wherein the respective base portions of said fin-base plates are spirally wound around the outer surfaces of the respective heat transfer tubes.

4. A heat exchanger as claimed in claim 2, wherein the respective base portions of said fin-base plates are spirally wound around the outer surfaces of the respective heat transfer tubes.

* * * * *